US008029644B2

(12) United States Patent
Kramp et al.

(10) Patent No.: US 8,029,644 B2
(45) Date of Patent: Oct. 4, 2011

(54) CONTROLLED TEMPERATURE SCRAP REMOVAL FOR TAPE PROCESS

(75) Inventors: Robert A. Kramp, Bonney Lake, WA (US); Robert A. Kisch, Auburn, WA (US); Matthew K. Lum, Mercer Island, WA (US)

(73) Assignee: The Beoing Company, Chicago, IL (US)

( * ) Notice: Subject to any disclaimer, the term of this patent is extended or adjusted under 35 U.S.C. 154(b) by 946 days.

(21) Appl. No.: 11/940,457

(22) Filed: Nov. 15, 2007

(65) Prior Publication Data

US 2009/0127374 A1 May 21, 2009

(51) Int. Cl.
*B32B 38/18* (2006.01)
*B32B 38/10* (2006.01)
*B32B 38/04* (2006.01)

(52) U.S. Cl. ..... 156/719; 156/934; 156/764; 156/767; 156/598; 156/270; 156/192; 156/248; 156/257; 156/268; 156/353; 156/510; 156/543; 156/272.2; 156/272.8; 156/379.6

(58) Field of Classification Search ..... 156/248, 156/257, 268, 192, 510, 353, 543, 256, 270, 156/272.2, 272.8, 379.6, FOR. 100, FOR. 101, 156/934, 764, 767, 598, 719
See application file for complete search history.

(56) References Cited

U.S. PATENT DOCUMENTS 3,784,043 A 1/1974 Presnick
3,850,729 A * 11/1974 Paulson et al. ..... 156/390
3,908,439 A 9/1975 Peiak et al.
3,933,026 A 1/1976 Ham
4,156,123 A 5/1979 Fischer et al.
4,173,139 A 11/1979 Conn
4,266,154 A 5/1981 Marshall
4,393,987 A 7/1983 Anderson et al.
4,406,153 A 9/1983 Ophir et al.
4,445,360 A 5/1984 Treder, Jr.
4,466,270 A 8/1984 Kimura et al.
4,566,330 A 1/1986 Fujii et al.
4,660,419 A 4/1987 Derkacs
4,674,334 A 6/1987 Chimenti et al.
4,729,235 A 3/1988 Podlech
4,747,295 A 5/1988 Feist et al.
4,779,452 A 10/1988 Cohen-Tenoudji
5,054,310 A 10/1991 Flynn
5,065,520 A 11/1991 Kaminagun
RE33,789 E 1/1992 Stevenson
(Continued)

FOREIGN PATENT DOCUMENTS

DE 2814336 B1 5/1979
(Continued)

*Primary Examiner* — Linda L Gray
(74) *Attorney, Agent, or Firm* — Klintworth & Rozenblat IP LLC

(57) ABSTRACT

In one embodiment, an apparatus for removing scrap from tape material on original backing paper includes a supply reel, at least one cutting member, at least one heating member and/or cooling member, and at least one removal member. The supply reel is for supplying and unrolling tape material on original backing paper. The at least one cutting member is for cutting unrolled tape material while on original backing paper. The at least one of a heating member and a cooling member are for at least one of heating and cooling cut unrolled tape material on original backing paper. The at least one removal member is for removing scrap cut unrolled tape material from original backing paper.

39 Claims, 4 Drawing Sheets

U.S. PATENT DOCUMENTS

| | | | | |
|---|---|---|---|---|
| 5,127,268 | A | 7/1992 | Kline | |
| 5,163,027 | A | 11/1992 | Miller et al. | |
| 5,163,077 | A | 11/1992 | Dupre | |
| 5,196,343 | A | 3/1993 | Zerhouni et al. | |
| 5,238,556 | A | 8/1993 | Shirkhan | |
| 5,312,755 | A | 5/1994 | Madsen et al. | |
| 5,525,385 | A | 6/1996 | Weinstein et al. | |
| 5,637,175 | A | 6/1997 | Feygin et al. | |
| 5,656,763 | A | 8/1997 | Flax | |
| 5,662,566 | A | 9/1997 | Marxrieser et al. | |
| 5,837,880 | A | 11/1998 | Shakinovsky et al. | |
| 6,106,645 | A * | 8/2000 | Stempien | 156/64 |
| 6,238,343 | B1 | 5/2001 | Madsen et al. | |
| 6,405,583 | B1 | 6/2002 | Shirakawabe et al. | |
| 6,415,051 | B1 | 7/2002 | Callari et al. | |
| 6,415,644 | B1 | 7/2002 | Rockwood et al. | |
| 6,426,274 | B1 | 7/2002 | Tayanaka | |
| 6,649,516 | B2 | 11/2003 | Asakawa et al. | |
| 6,684,701 | B2 | 2/2004 | Dubois et al. | |
| 6,803,095 | B1 | 10/2004 | Halladay et al. | |
| 6,843,945 | B1 | 1/2005 | Hsai-Yin Lee | |
| 6,925,145 | B2 | 8/2005 | Batzinger | |
| 6,959,602 | B2 | 11/2005 | Peterson et al. | |
| 6,962,701 | B2 | 11/2005 | Koenig | |
| 6,962,739 | B1 | 11/2005 | Kim et al. | |
| 7,010,980 | B2 | 3/2006 | Meier | |
| 7,076,992 | B2 | 7/2006 | Greelish | |
| 7,188,559 | B1 | 3/2007 | Vecchio | |
| 7,216,544 | B2 | 5/2007 | Vaccaro et al. | |
| 7,320,241 | B2 | 1/2008 | Kollgaard et al. | |
| 7,326,315 | B2 * | 2/2008 | Behnen | 156/253 |
| 7,353,709 | B2 | 4/2008 | Kruger et al. | |
| 7,357,014 | B2 | 4/2008 | Vaccaro et al. | |
| 7,418,860 | B2 | 9/2008 | Austerlitz et al. | |
| 7,424,818 | B2 | 9/2008 | Vaccaro et al. | |
| 7,509,832 | B2 | 3/2009 | Vaccaro et al. | |
| 7,510,817 | B2 | 3/2009 | Benoit et al. | |
| 7,879,177 | B2 * | 2/2011 | McCowin et al. | 156/303 |
| 2002/0047263 | A1 * | 4/2002 | McCarthy et al. | 283/107 |
| 2006/0213250 | A1 | 9/2006 | Vaccaro et al. | |
| 2006/0234391 | A1 | 10/2006 | Weiss et al. | |
| 2006/0265679 | A1 | 11/2006 | Scheffer et al. | |
| 2007/0065620 | A1 * | 3/2007 | Nonaka et al. | 428/40.1 |
| 2007/0107520 | A1 | 5/2007 | Vaccaro et al. | |
| 2007/0125177 | A1 | 6/2007 | Vacaro et al. | |
| 2008/0087093 | A1 | 4/2008 | Engelbart et al. | |
| 2008/0134749 | A1 | 6/2008 | Engelbart et al. | |
| 2008/0196475 | A1 | 8/2008 | Engelbart et al. | |

FOREIGN PATENT DOCUMENTS

| | | | |
|---|---|---|---|
| GB | 2221991 | A | 2/1990 |
| JP | 61265565 | | 11/1986 |
| JP | 08210953 | A | 8/1996 |
| WO | 90/13024 | A1 | 11/1990 |

* cited by examiner

CONTROLLED TEMPERATURE SCRAP REMOVAL FOR TAPE PROCESS

BACKGROUND

Some apparatus and methods exist for automatically preparing cassette spools wound with tape material on backing paper, and/or for removing scrap from tape material on original backing paper. This tape material may be used to form a laminate. In one existing apparatus/method, tape material on backing paper is unrolled from a supply reel, the tape material is cut into the required configuration, removed from the original backing paper, and then transferred to another release backing paper and wound onto a cassette spool. However, the transferring of the tape material to another backing paper may create problems. The tape material may lose some of its tacking ability, may not align as well on the new backing paper, may not adhere well to the new backing paper, and may have placement problems when placed on a working surface. Further, the new backing paper may have a certain amount of stretch which may cause tension problems, may form wrinkles when the tape is placed onto a working surface, and/or may not allow good tacking of the tape material onto the working surface. This may cause problems with tape lifting from the working surface, or may cause wrinkles to be formed in the laminate being formed with the tape material. Moreover, the process of putting the tape material onto a new backing paper may require an excessive number of machines, may increase the costs, may increase the time required, may reduce efficiency, and/or may lead to one or more other problems.

An apparatus, and/or method for preparing a cassette spool, is needed to decrease one or more problems associated with one or more of the existing apparatus and/or methods.

SUMMARY

In one aspect of the disclosure, an apparatus for removing scrap from tape material on original backing paper comprises: (1) a supply reel for supplying and unrolling tape material on original backing paper; (2) at least one cutting member for cutting unrolled tape material while on original backing paper; (3) at least one of a heating member and a cooling member for at least one of heating and cooling cut unrolled tape material on original backing paper; and (4) at least one removal member for removing scrap cut unrolled tape material from original backing paper.

In another aspect of the disclosure, a method of removing tape material from original backing paper is provided. In one step, tape material on original backing paper is unrolled from a supply reel. In another step, the unrolled tape material on the original backing paper is cut with at least one cutting member to form scrap cut unrolled tape material on the original backing paper and to form non-scrap cut unrolled tape material on the original backing paper. In still another step, the non-scrap cut unrolled tape material is heated on the original backing paper utilizing a heating member and/or the scrap cut unrolled tape material on the original backing paper is cooled utilizing a cooling member. In an additional step, the scrap cut unrolled tape material is removed from the original backing paper utilizing at least one removal member.

These and other features, aspects and advantages of the disclosure will become better understood with reference to the following drawings, description and claims.

DETAILED DESCRIPTION

The following detailed description is of the best currently contemplated modes of carrying out the disclosure. The description is not to be taken in a limiting sense, but is made merely for the purpose of illustrating the general principles of the disclosure, since the scope of the disclosure is best defined by the appended claims.

Figure 1:
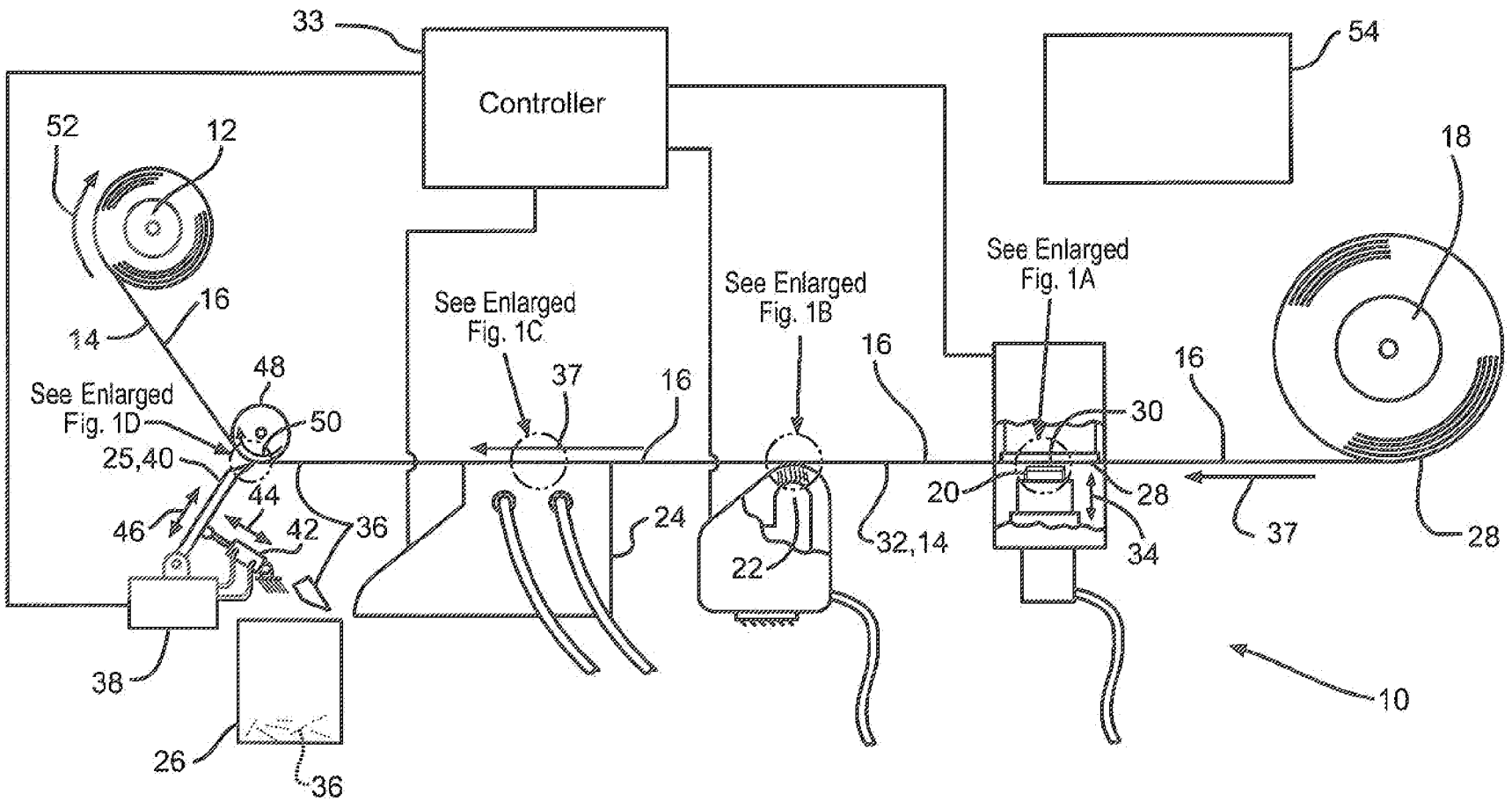
FIG. 1 shows a side view of one embodiment of an apparatus for preparing/processing a cassette spool with cut non-scrap tape material on original backing paper wound around the cassette spool.

FIG. 1 shows a side view of one embodiment of an apparatus 10 for preparing/processing a cassette spool 12 with cut non-scrap tape material 14 on original backing paper 16 wound around the cassette spool 12. The apparatus 10 may comprise a supply reel 18, one or more cutting members 20, a heating member 22 and/or a cooling member 24, one or more removal members 25, a scrap bin 26, and the cassette spool 12. The supply reel 18 may be adapted to supply and unroll uncut tape material 28 which is on original backing paper 16 and wound around the supply reel 18. In one embodiment, the tape material 28 may comprise composite tape. In another embodiment, the tape material 28 may comprise unidirectional composite tape made of Kevlar, Graphite, Fiberglass, or other type of material. In yet another embodiment, the tape material 28 may be made of Graphite, Ceramic, Aramid, and glass. In one embodiment, the unrolled uncut tape material 28 may be 1.5 inches to 12 inches wide. In other embodiments, the unrolled uncut tape material 28 may be of varying shapes, sizes, and configurations. The original backing paper 16 may comprise a polymeric matrix material made of Paper, Polyster, Mylar, Tedlar, Polyurethane, or other type of material, such as a paper coated with a release material.

In FIG. 1, the one or more cutting members 20, which may each comprise at least one sharp cutting edge 30, are shown in positions disposed against the unrolled uncut tape material 28 which is still on the original backing paper 16. In other embodiments, the one or more cutting members 20 may comprise a blade, a knife such as an ultrasonic knife, a stylus knife, or other type of knife. In these or other positions, the one or more cutting members 20 are adapted to cut a portion 32 of the unrolled tape material 28 while on the original backing paper 16 to obtain non-scrap cut tape material 14 in a pre-determined configuration while it is still on the original backing paper 16, without cutting off the original backing paper 16 from the cut portion 32. One or more computers 33 may direct/control the cutting members 20 to cut portions 32 of the unrolled tape material 28 in a pre-determined configuration while still on the original backing paper 16.

After cutting portion 32, the cutting members 20 are adapted to be moved along direction 34 in order to disengage from cut portion 32. This may allow another scrap portion 36 of the unrolled tape material 28, with the original backing paper 16 still on it, to pass by the cutting members 20 without being cut. The one or more computers 33 may direct/control the cutting members 20 to avoid the scrap portions 36 of the unrolled tape material 28 on the original backing paper 16 from being cut. Subsequently, the cutting members 20 may be adapted to be moved downwardly and upwardly along direction 34 at various times in order to engage and disengage from unrolled tape material 28 in order to selectively cut portions 32 and selectively not cut scrap portions 36. The cut portion 32 of unrolled tape material 28 on the original backing paper 16 may move in direction 37 to heating member 22.

Figure 1A:
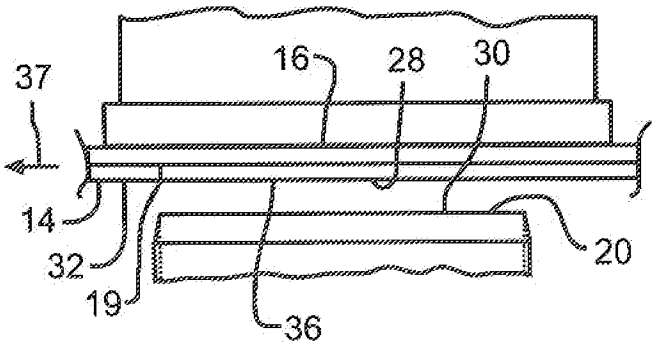
FIG. 1A shows an enlarged view within circle 1A of FIG. 1.

FIG. 1A shows an enlarged view within circle 1A of FIG. 1. FIG. 1A shows a close-up of the cut portion 32 already having been cut by the cutting members 20 at cut-line 19 while remaining on the original backing paper 16 to form cut tape material 14 and scrap tape material 36, both still on the original backing paper 16, the cutting members 20 having already moved downwardly away from cut portion 32 and cut-line 19, and cut portion 32 and cut-line 19 already having moved in direction 37 after being cut.

The heating member 22 may comprise a laser, hot-air, heated chutes, an infra-red device, or other heating member. The heating member 22 may heat the non-scrap cut tape material 14 on the original backing paper 16 to help the non-scrap cut tape material 14 to stay on the original backing paper 16 until it is rolled up by the cassette spool 12. The heating member 22 may not heat the scrap cut unrolled tape material 36 on the original backing paper 16 to help avoid the scrap cut unrolled tape material 36 from staying on the original backing paper 16. The one or more computers 33 may direct/control the heating member 22 to apply heat to non-scrap cut tape material 14 on the original backing paper 16, and not to apply heat to scrap cut unrolled tape material 36 on the original backing paper 16. Both the non-scrap cut tape material 14 on the original backing paper 16 and the scrap cut unrolled tape material 36 on the original backing paper 16 may then continue to move in direction 37 to cooling member 24.

Figure 1B:
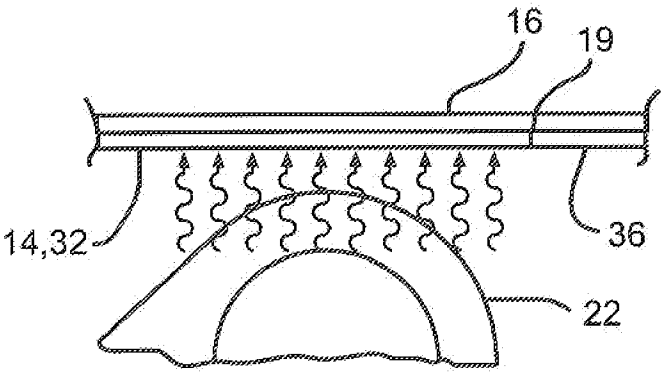
FIG. 1B shows an enlarged view within circle 1B of FIG. 1.

FIG. 1B shows an enlarged view within circle 1B of FIG. 1. FIG. 1B shows a close-up of the heating member 22 heating up the cut portion 32 of the cut tape material 14 beyond cut-line 19 with the cut portion 32 remaining on the original backing paper 16. The scrap tape material 36 after cut-line 19 is not heated, but likewise remains on the original backing paper 16.

The cooling member 24 may comprise chilled air, chutes, or other cooling member. The cooling member 24 may cool the scrap cut unrolled tape material 36 on the original backing paper 16 to help the scrap cut unrolled tape material 36 to come off the original backing paper 16 so that it is not rolled up by the cassette spool 12. The cooling member 24 may not cool the non-scrap cut tape material 14 on the original backing paper 16 to help avoid the non-scrap cut tape material 14 from coming off the original backing paper 16 before it is rolled up by the cassette spool 12. The one or more computers 33 may direct/control the cooling member 24 to cool the scrap cut unrolled tape material 36 on the original backing paper 16, and to not cool the non-scrap cut tape material 14 on the original backing paper 16. In other embodiments, the apparatus 10 may only have one of heating member 22 and cooling member 24. Both the scrap cut unrolled tape material 36 on the original backing paper 16 and the non-scrap cut tape material 14 on the original backing paper 16 may then continue to move in direction 37 to at least one removal member 25.

Figure 1C:
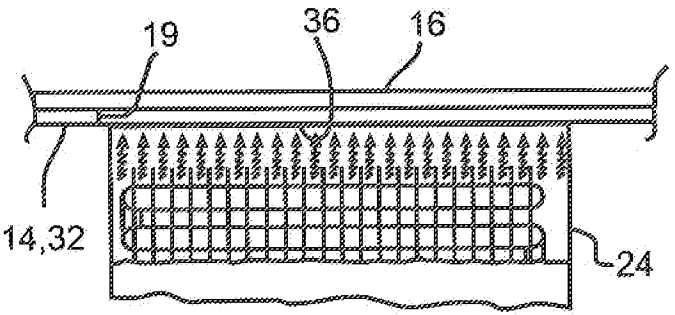
FIG. 1C shows an enlarged view within circle 1C of FIG. 1.

FIG. 1C shows an enlarged view within circle 1C of FIG. 1. FIG. 1C shows a close-up of the cut portion 32 of the cut tape material 14 ahead of cut-line 19 still on the original backing paper 16 having passed by the cooling member 24 without being cooled. It also shows the scrap tape material 36 after cut-line 19 still on the original backing paper 16 being cooled by the cooling member 24.

The removal member 25 may be designed to remove the scrap cut unrolled tape material 36 from the original backing paper 16 without removing the non-scrap cut tape material 14 from the original backing paper. The removal member 25 may comprise an actuator 38. The actuator 38 may comprise one or more arm members 40, driven by one or more pistons 42, which are adapted to travel up and down along direction 44 to selectively abut against and remove the scrap cut unrolled tape material 36 from the original backing paper 16. The scrap cut unrolled tape material 36 which is removed by the removal member 25 may have been cooled by the cooling member 24, which may assist in the removal process. The removed scrap cut unrolled tape material 36 may be deposited into at least one scrap bin 26 for disposal.

The arm members 40 of the actuator 38 may also be adapted to travel along direction 46 so that they do not abut against nor remove the non-scrap cut tape material 14 from the original backing paper 16. The non-scrap cut tape material 14 may have been heated by the heating member 22, which may assist in keeping the tape material 14 on the original backing paper 16. The one or more computers 33 may direct/control the arm members 40 of the actuator 38 to abut against and remove the scrap cut unrolled tape material 36 from the original backing paper 16, and not to abut against nor remove the non-scrap cut tape material 14 from the original backing paper 16.

Instead of, or in conjunction with the actuator 38, the removal member 25 may comprise at least one curved surface 48. The curved surface 48 may comprise a roller member or other type of curved surface. When the scrap cut unrolled tape material 36 travels in direction 50 along the curved surface 48, the scrap cut unrolled tape material 36 may come off the original backing paper 16 as a result of the change of direction of the curved surface 48. The scrap cut unrolled tape material 36 may have been cooled by the cooling member 24, which may assist in the removal process. The removed scrap cut unrolled tape material 36 may be deposited into the at least one scrap bin 26 for disposal. When the non-scrap cut tape material 14 on the original backing paper 16 travels in direction 50 along the curved surface 48, the non-scrap cut tape material 14 may stay on the original backing paper 16. The non-scrap cut tape material 14 may have been heated by the heating member 22, which may assist in the tape material 14 staying on the original backing paper 16.

The non-scrap cut tape material 14 on the original backing paper 16 may travel along direction 52 and be rolled up by the cassette spool 12. The non-scrap cut tape material 14 on the original backing paper 16 which is rolled up by the cassette spool 12 may have been heated by the heating member 22. The cassette spool 12 may not roll up scrap cut unrolled tape material 36, which may have been cooled by the cooling member 24, which may have been removed from the original backing paper 16 by the removal member 25, and which may have been placed in the scrap bin 26. The cassette spool 12 of rolled up non-scrap cut tape material 14 may then be loaded into and used in a tape laying machine 54 and used during at least one of aircraft pre-production, aircraft production, and aircraft service. In another embodiment, single-phase tape laying equipment and/or processes may be utilized without rolling up the non-scrap cut tape material onto a cassette spool 12. In that embodiment, the removal of the scrap cut unrolled tape material 36 may be done in real time on a single-phase tape laying machine as part of a tape lay-up without rolling up the non-scrap cut tape material onto a cassette spool 12.

Figure 1D:
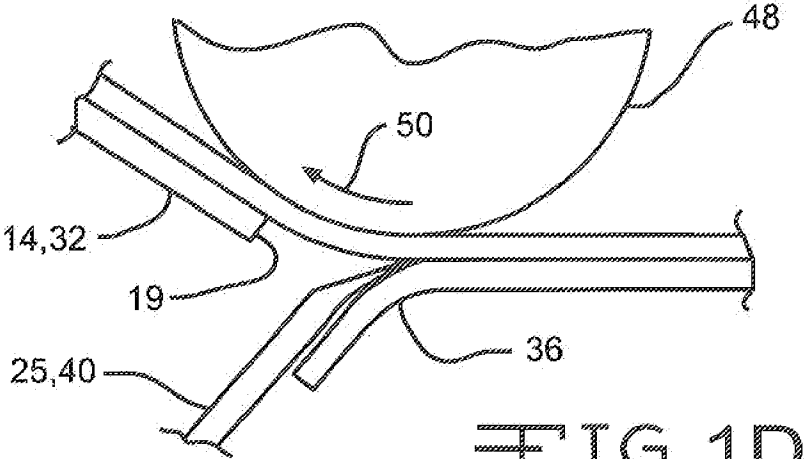
FIG. 1D shows an enlarged view within circle 1D of FIG. 1.

FIG. 1D shows an enlarged view within circle 1D of FIG. 1. FIG. 1D shows a close-up of the heated up cut portion 32 of cut tape material 14 beyond cut-line 19 having passed by the removal member 25 and curved surface 48 while remaining on the original backing paper 16. It also shows the cooled scrap tape material 36 after cut-line 19 being removed from the original backing paper 16 by the removal member 25.

Figure 2:
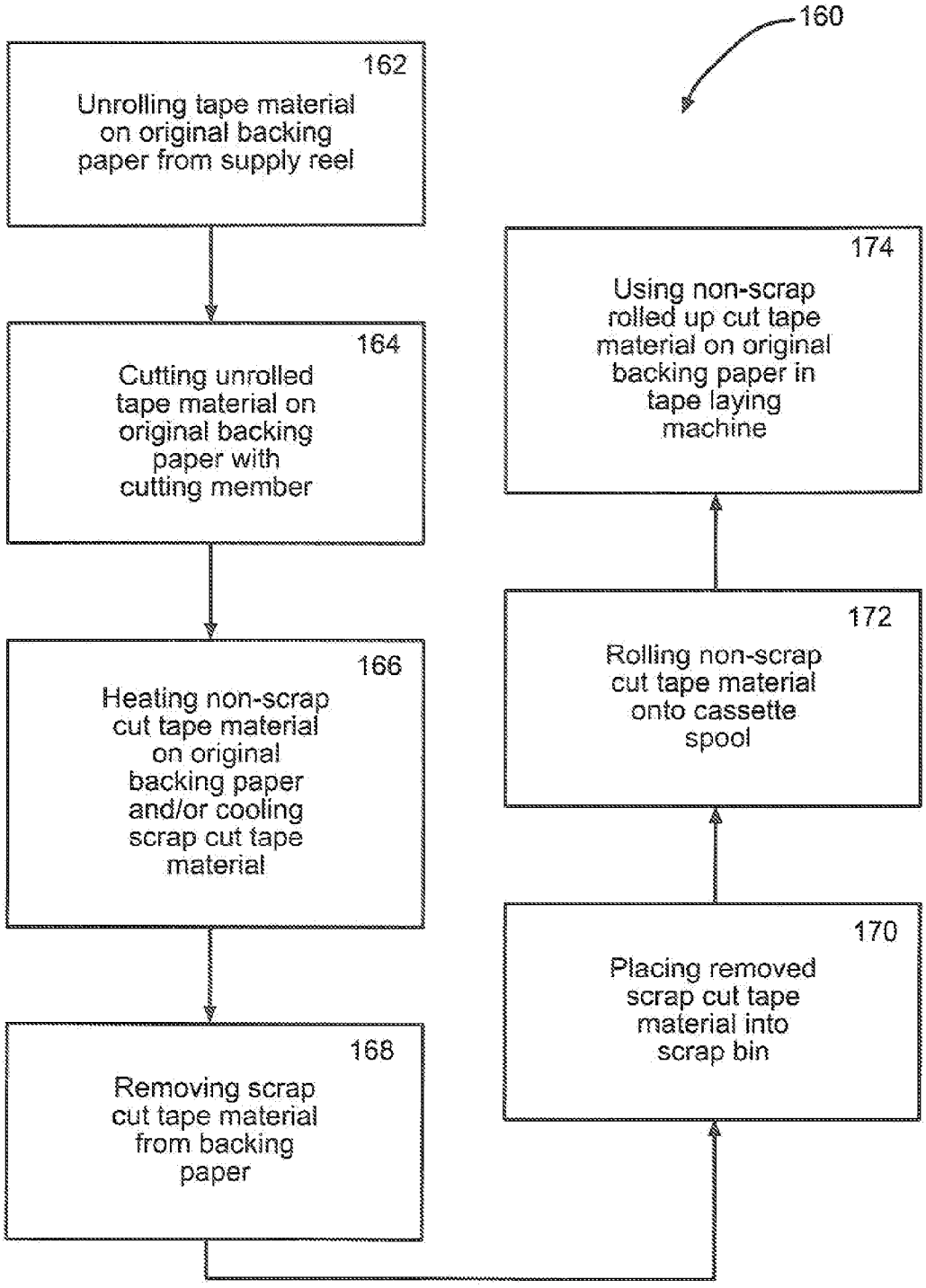
FIG. 2 is a flowchart showing one embodiment of a method of removing scrap tape material from original backing paper.

FIG. 2 shows a flowchart 160 of an embodiment of a method of removing scrap tape material 36 from original backing paper 16. In one embodiment, the tape material 28 may comprise composite tape. In another embodiment, the tape material 28 may comprise unidirectional composite tape made of Kevlar, Graphite, Fiberglass, or other type of material. In yet another embodiment, the tape material 28 may be made of Ceramic, Aramid, and glass. In one embodiment, the original backing paper 16 may comprise a polymeric matrix material made of Paper, Polyster, Mylar, Tedlar, Polyurethane, or other type of material, such as a paper coated with a release material.

In one step 162, tape material 28 on original backing paper 16 may be unrolled from a supply reel 18. In another step 164, the unrolled tape material 28 on the original backing paper 16 may be cut with at least one cutting member 20, without cutting the backing paper 16, to form scrap cut unrolled tape material 36 on the original backing paper 16, and to form non-scrap cut tape material 14 on the original backing paper 16. The cutting member 20 may comprise at least one sharp edge 30. At least one computer 33 may direct the cutting member 20 to cut the unrolled tape material 28 on the original backing paper 16 in a pre-determined configuration.

In still another step 166, the non-scrap cut tape material 14 on the original backing paper 16 may be heated utilizing a heating member 22 and/or the scrap cut unrolled tape material 36 on the original backing paper 16 may be cooled utilizing a cooling member 24. In yet another step 168, the scrap cut unrolled tape material 36, which may have been cooled by the cooling member 24, may be removed from the original backing paper 16 utilizing at least one removal member 25. The removal member 25 may comprise at least one of a curved surface 48 which changes the direction of the cut non-scrap and scrap tape material 14 and 36 on the original backing paper 16, and an actuator 38 which selectively abuts against the scrap cut unrolled tape material 36 on the original backing paper 16. The removing step 168 may not comprise removing the non-scrap cut tape material 14, which may have been heated using the heating member 22, from the original backing paper 16. In an additional step 170, the scrap cut unrolled tape material 36 which has been removed from the original backing paper 16 may be placed into at least one scrap bin 26.

In an additional step 172, the non-scrap cut tape material 14 on the original backing paper 16 may be rolled onto a cassette spool 12. The rolling step 172 may comprise rolling up the non-scrap cut composite tape material 14, which may have been heated using the heating member 22, on the original backing paper 16. The rolling step 172 may not comprise rolling up the scrap cut unrolled tape material 36, which may have been cooled using the cooling member 24 and which may have been removed from the original backing paper 16. In another embodiment, single-phase tape laying equipment and/or processes may be utilized without rolling up the non-scrap cut tape material onto a cassette spool 12. In that embodiment, the removal of the scrap cut unrolled tape material 36 may be done in real time on a single-phase tape laying machine without rolling up the non-scrap cut tape material onto a cassette spool 12. In yet another step 174, the non-scrap cut tape material 14 on the original backing paper 16, which has been rolled up onto the cassette spool 12, may be loaded and used in a tape laying machine 54 and subsequently used during at least one of aircraft pre-production, aircraft production, and aircraft service.

One or more embodiment of the disclosure may reduce and/or eliminate one or more problems which may have been experienced by one or more of the existing apparatus or methods. For instance, one or more embodiments of the disclosure may reduce the numbers and amounts of backing paper needed, may reduce costs, may reduce the number of machines required, may substantially reduce time since the process may be carried out without transferring cut tape to new backing paper, may lead to less wrinkling and/or tension in the tape material against the backing paper since new backing paper is not required, may improve the adherence of the cut tape to the backing paper since new backing paper is not required, may reduce tacking problems, may reduce problems in transferring tape resin to new backing paper, may improve efficiency, may be less complex, may be more reliable, may be more accurate, may make it less difficult to place tape against working surfaces by providing improved tracking and guidance, may reduce tape lifting from working surfaces, and/or may reduce and/or eliminate one or more other types of problems in one or more of the existing apparatus and/or methods.

Figure 3:
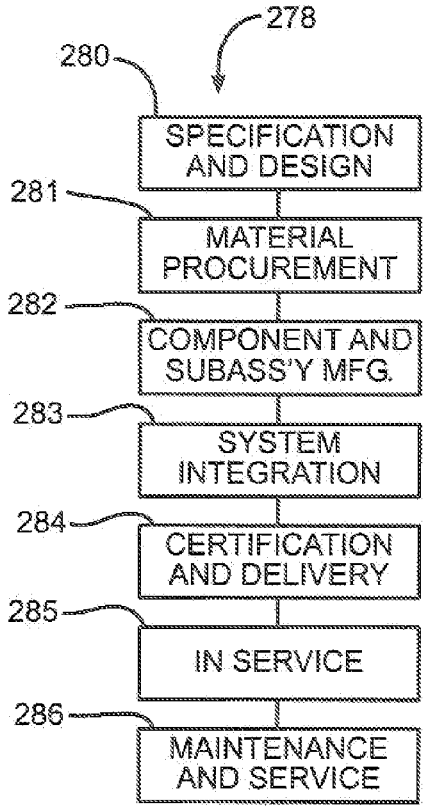
FIG. 3 is a flow diagram of aircraft production and service methodology.
Figure 4:
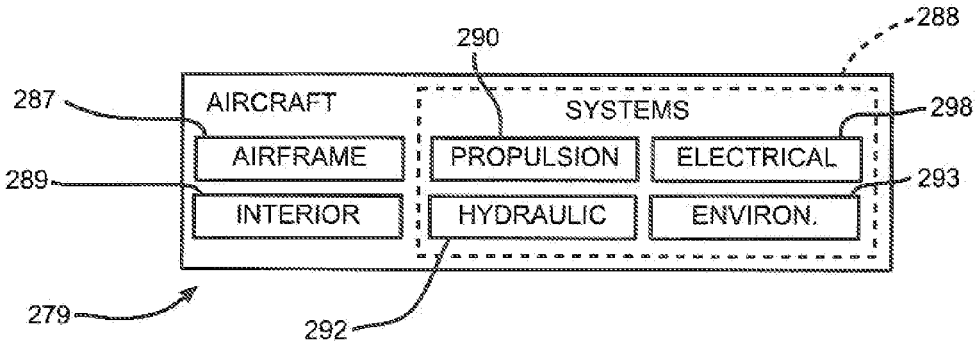
FIG. 4 is a block diagram of an aircraft.

Referring more particularly to the drawings, embodiments of the disclosure may be described in the context of an aircraft manufacturing and service method 278 as shown in FIG. 3 and an aircraft 279 as shown in FIG. 4. During pre-production, exemplary method 278 may include specification and design 280 of the aircraft 279 and material procurement 281. During production, component and subassembly manufacturing 282 and system integration 283 of the aircraft 279 takes place. Thereafter, the aircraft 279 may go through certification and delivery 284 in order to be placed in service 285. While in service by a customer, the aircraft 279 is scheduled for routine maintenance and service 286 (which may also include modification, reconfiguration, refurbishment, and so on).

Each of the processes of method 278 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 4, the aircraft 279 produced by exemplary method 278 may include an airframe 287 with a plurality of systems 288 and an interior 289. Examples of high-level systems 288 include one or more of a propulsion system 290, an electrical system 291, a hydraulic system 292, and an environmental system 293. Any number of other systems may be included. Although an aerospace example is shown, the principles of the invention may be applied to other industries, such as the automotive industry.

Apparatus and methods embodied herein may be employed during any one or more of the stages of the production and service method 278. For example, components or subassemblies corresponding to production process 282 may be fabricated or manufactured in a manner similar to components or subassemblies produced while the aircraft 279 is in service. Also, one or more apparatus embodiments, method embodiments, or a combination thereof may be utilized during the production stages 282 and 283, for example, by substantially expediting assembly of or reducing the cost of an aircraft 279. Similarly, one or more of apparatus embodiments, method embodiments, or a combination thereof may be utilized while the aircraft 279 is in service, for example and without limitation, to maintenance and service 286.

It should be understood, of course, that the foregoing relates to exemplary embodiments of the disclosure and that modifications may be made without departing from the spirit and scope of the disclosure as set forth in the following claims.

The invention claimed is:

1. An apparatus for removing scrap from tape on original backing paper comprising:

a supply reel for supplying and unrolling material, wherein said material comprises tape on original backing paper;

at least one cutting member for cutting unrolled tape while on original backing paper;

a heating member for heating non-scrap cut unrolled tape on original backing paper;

at least one removal member for removing scrap cut unrolled tape from original backing paper; and a cassette spool for rolling up heated non-scrap cut unrolled tape on original backing paper which has been heated by said heating member.

2. The apparatus of claim 1 further comprising at least one computer, wherein said at least one computer is adapted to direct said at least one cutting member to cut unrolled tape on original backing paper in a pre-determined configuration to produce both scrap cut unrolled tape on original backing paper and non-scrap cut unrolled tape on original backing paper.

3. The apparatus of claim 1 wherein said heating member is for heating non-scrap cut unrolled tape on original backing paper without heating scrap cut unrolled tape on original backing paper.

4. The apparatus of claim 1 further comprising a cooling member for cooling scrap cut unrolled tape on original backing paper without cooling non-scrap cut unrolled tape on original backing paper.

5. The apparatus of claim 1 wherein said at least one removal member comprises an actuator for abutting an arm member against scrap cut unrolled tape on original backing paper.

6. The apparatus of claim 4 wherein said at least one removal member is for removing cooled scrap cut unrolled tape from original backing paper.

7. The apparatus of claim 3 wherein said at least one removal member does not remove heated non-scrap cut unrolled tape from original backing paper.

8. The apparatus of claim 1 further comprising a cooling member for cooling scrap cut unrolled tape on original backing paper, wherein said removal member is for removing cooled scrap cut unrolled tape from original backing paper and said cassette spool does not roll up cooled scrap cut unrolled tape which has been cooled by said cooling member and removed from original backing paper by said removal member.

9. The apparatus of claim 1 wherein the tape is made of at least one of a composite, graphite, ceramic, aramid, glass, unidirectional composite tape, a para-aramid synthetic fiber, or fiberglass.

10. The apparatus of claim 1 further comprising at least one scrap bin for disposing of scrap cut unrolled tape which has been removed from original backing paper.

11. The apparatus of claim 1 further comprising at least one computer, wherein said at least one computer is adapted to control said heating.

12. A method of removing tape from original backing paper comprising:

unrolling material from a supply reel, wherein said material comprises tape on original backing paper;

cutting the unrolled tape on the original backing paper with at least one cutting member to form scrap cut unrolled tape on the original backing paper and to form non-scrap cut unrolled tape on the original backing paper;

heating the non-scrap cut unrolled tape on the original backing paper utilizing a heating member;

removing the scrap cut unrolled tape from the original backing paper utilizing at least one removal member; and rolling up the non-scrap cut unrolled tape, which has been heated by the heating member, on the original backing paper onto a cassette spool.

13. The method of claim 12 wherein the method is used during at least one of aircraft pre-production, aircraft production, or aircraft service.

14. The method of claim 12 further comprising the step of at least one computer directing said at least one cutting member to cut the unrolled tape on the original backing paper in a pre-determined configuration.

15. The method of claim 12 wherein the non-scrap cut unrolled tape on the original backing paper is heated by the heating member without heating the scrap cut unrolled tape on the original backing paper, and the scrap cut unrolled tape on the original backing paper is cooled by a cooling member without cooling the non-scrap cut unrolled tape on the original backing paper.

16. The method of claim 12 wherein said at least one removal member comprises an actuator which selectively abuts an arm member against the scrap cut unrolled tape on the original backing paper.

17. The method of claim 15 wherein the step of removing comprises removing the cooled scrap cut unrolled tape, which has been cooled by the cooling member, from the original backing paper utilizing said at least one removal member.

18. The method of claim 17 wherein the step of removing does not comprise removing the heated non-scrap cut unrolled tape, which has been heated by the heating member, from the original backing paper.

19. The method of claim 12 further comprising cooling the scrap cut unrolled tape with a cooling member prior to removing it with said at least one removal member, wherein the step of rolling does not comprise said cassette spool rolling up the scrap cut unrolled tape, which has been cooled by the cooling member, and removed from the original backing paper with said at least one removal member.

20. The method of claim 12 wherein the tape is made of at least one of a composite, graphite, ceramic, aramid, glass, unidirectional composite tape, a para-aramid synthetic fiber, or fiberglass.

21. The method of claim 12 further comprising the step of disposing said scrap cut unrolled tape which has been removed from the original backing paper into at least one scrap bin.

22. The method of claim 12 further comprising the step of using the rolled up non-scrap cut unrolled tape on the original backing paper on the cassette spool with a tape laying machine.

23. The method of claim 12 further comprising the step of at least one computer controlling said heating.

24. An apparatus for removing scrap from tape on original backing paper comprising:

a supply reel for supplying and unrolling material, wherein said material comprises tape on original backing paper;

at least one cutting member for cutting unrolled tape while on original backing paper;

at least one computer, wherein said at least one computer is adapted to direct said at least one cutting member to cut unrolled tape on original backing paper in a pre-determined configuration to produce both scrap cut unrolled tape on original backing paper and non-scrap cut unrolled tape on original backing paper;

a heating member for heating non-scrap cut unrolled tape on original backing paper without heating scrap cut unrolled tape on original backing paper, and a cooling member for cooling scrap cut unrolled tape on original backing paper without cooling non-scrap cut unrolled tape on original backing paper, wherein said at least one computer is adapted to control said heating and cooling;

at least one removal member for removing cooled scrap cut unrolled tape from original backing paper without removing heated non-scrap cut unrolled tape from original backing paper, wherein said at least one removal member comprises at least one of a curved surface for changing the direction of cut unrolled tape on original backing paper or an actuator for abutting an arm member against cooled scrap cut unrolled tape on original backing paper; and a cassette spool for rolling up heated non-scrap cut unrolled tape on original backing paper without rolling up cooled scrap cut unrolled tape which has been removed from original backing paper.

25. The apparatus of claim 24 wherein the apparatus is for preparing the cassette spool of rolled-up heated non-scrap cut tape on original backing paper, wherein the tape is made of at least one of a composite, graphite, ceramic, aramid, glass, unidirectional composite tape, a para-aramid synthetic fiber, or fiberglass.

26. The apparatus of claim 24 further comprising at least one scrap bin for disposing of cooled scrap cut unrolled tape which has been removed from original backing paper.

27. A method of removing tape from original backing paper comprising:

unrolling material from a supply reel, wherein said material comprises tape on original backing paper;

cutting the unrolled tape on the original backing paper with at least one cutting member to form scrap cut unrolled tape on the original backing paper and to form non-scrap cut unrolled tape on the original backing paper, wherein at least one computer directs said at least one cutting member to cut the unrolled tape on the original backing paper in a pre-determined configuration;

heating the non-scrap cut unrolled tape on the original backing paper utilizing a heating member without heating the scrap cut unrolled tape on the original backing paper and cooling the scrap cut unrolled tape on the original backing paper utilizing a cooling member without cooling the non-scrap cut unrolled tape on the original backing paper, wherein the at least one computer controls said heating and cooling;

removing the cooled scrap cut unrolled tape from the original backing paper without removing the heated non-scrap cut unrolled tape from the backing paper utilizing at least one removal member comprising at least one of a curved surface which changes the direction of the cut unrolled tape on the original backing paper or an actuator which selectively abuts an arm member against the cooled scrap cut unrolled tape on the original backing paper; and rolling up the heated non-scrap cut unrolled tape on the original backing paper onto a cassette spool without rolling up the cooled scrap cut unrolled tape removed from the original backing paper.

28. The method of claim 27 wherein the method is used during at least one of aircraft pre-production, aircraft production, or aircraft service.

29. The method of claim 27 wherein the tape is made of at least one of a composite, graphite, ceramic, aramid, glass, unidirectional composite tape, a para-aramid synthetic fiber, or fiberglass.

30. The method of claim 27 further comprising the step of disposing said cooled scrap cut unrolled tape which has been removed from the original backing paper into at least one scrap bin.

31. The method of claim 27 further comprising the step of using the rolled up heated non-scrap cut unrolled tape on the original backing paper on the cassette spool with a tape laying machine.

32. The apparatus of claim 24 wherein said at least one removal member comprises the actuator for abutting the arm member against cooled scrap cut unrolled tape on original backing paper.

33. The method of claim 27 wherein the at least one removal member comprises the actuator which selectively abuts the arm member against the cooled scrap cut unrolled tape on the original backing paper.

34. An apparatus for removing scrap from tape on original backing paper comprising:

a supply reel for supplying and unrolling material, wherein said material comprises tape on original backing paper;

at least one cutting member for cutting unrolled tape while on original backing paper;

at least one of a heating member for heating non-scrap cut unrolled tape on original backing paper without heating scrap cut unrolled tape on original backing paper or a cooling member for cooling scrap cut unrolled tape on original backing paper without cooling non-scrap cut unrolled tape on original backing paper; and at least one removal member for removing scrap cut unrolled tape from original backing paper.

35. The apparatus of claim 34 comprising said heating member for heating non-scrap cut unrolled tape on original backing paper without heating scrap cut unrolled tape on original backing paper.

36. The apparatus of claim 34 comprising said cooling member for cooling scrap cut unrolled tape on original backing paper without cooling non-scrap cut unrolled tape on original backing paper.

37. A method of removing tape from original backing paper comprising:

unrolling material from a supply reel, wherein said material comprises tape on original backing paper;

cutting the unrolled tape on the original backing paper with at least one cutting member to form scrap cut unrolled tape on the original backing paper and to form non-scrap cut unrolled tape on the original backing paper;

at least one of heating, utilizing a heating member, the non-scrap cut unrolled tape on the original backing paper without heating the scrap cut unrolled tape on the original backing paper or cooling, utilizing a cooling member, the scrap cut unrolled tape on the original backing paper without cooling the non-scrap cut unrolled tape on the original backing paper; and removing the scrap cut unrolled tape from the original backing paper utilizing at least one removal member.

38. The method of claim 37 wherein the step of removing comprises removing the cooled scrap cut unrolled tape, which has been cooled by the cooling member, from the original backing paper utilizing said at least one removal member.

39. The method of claim 38 wherein the step of removing does not comprise removing the heated non-scrap cut unrolled tape, which has been heated by the heating member, from the original backing paper.

* * * * *